US011698594B2

(12) United States Patent
Takahashi et al.

(10) Patent No.: US 11,698,594 B2
(45) Date of Patent: Jul. 11, 2023

(54) TONER

(71) Applicant: CANON KABUSHIKI KAISHA, Tokyo (JP)

(72) Inventors: Toru Takahashi, Ibaraki (JP); Nobuyoshi Sugahara, Tokyo (JP); Hitoshi Sano, Chiba (JP); Kazunari Ooyama, Ibaraki (JP); Yuu Nishimura, Chiba (JP); Kohji Takenaka, Ibaraki (JP); Koh Ishigami, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 206 days.

(21) Appl. No.: 17/223,070

(22) Filed: Apr. 6, 2021

(65) Prior Publication Data

US 2021/0223710 A1 Jul. 22, 2021

Related U.S. Application Data

(63) Continuation of application No. PCT/JP2020/038024, filed on Oct. 7, 2020.

(30) Foreign Application Priority Data

Oct. 7, 2019 (JP) ..... 2019-184657

(51) Int. Cl.
*G03G 9/087* (2006.01)

(52) U.S. Cl.
CPC ..... *G03G 9/08755* (2013.01); *G03G 9/08773* (2013.01)

(58) Field of Classification Search
CPC ..... G03G 9/08759; G03G 9/09328
See application file for complete search history.

(56) References Cited

U.S. PATENT DOCUMENTS

| | | | |
|---|---|---|---|
| 6,326,114 | B1 | 12/2001 | Itakura et al. |
| 6,528,222 | B2 | 3/2003 | Kohtaki et al. |
| 6,586,147 | B2 | 7/2003 | Iida et al. |
| 6,751,424 | B2 | 6/2004 | Komatsu et al. |
| 6,929,894 | B2 | 8/2005 | Sugahara et al. |
| 7,022,449 | B2 | 4/2006 | Sugahara et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,320,850 | B2 | 1/2008 | Itakura et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,611,813 | B2 | 11/2009 | Ida et al. |
| 7,629,100 | B2 | 12/2009 | Okamoto et al. |
| 7,767,370 | B2 | 8/2010 | Ishigami et al. |
| 7,858,283 | B2 | 12/2010 | Ishigami et al. |
| 7,906,262 | B2 | 3/2011 | Ishigami et al. |
| 7,927,775 | B2 | 4/2011 | Komatsu et al. |
| 7,939,233 | B2 | 5/2011 | Inoue et al. |
| 8,114,562 | B2 | 2/2012 | Ishigami et al. |
| 8,137,886 | B2 | 3/2012 | Baba et al. |
| 8,298,742 | B2 | 10/2012 | Okamoto et al. |
| 8,323,726 | B2 | 12/2012 | Naka et al. |
| 8,501,377 | B2 | 8/2013 | Takahashi et al. |
| 8,512,925 | B2 | 8/2013 | Moribe et al. |

(Continued)

FOREIGN PATENT DOCUMENTS

| | | | | |
|---|---|---|---|---|
| JP | 08-087127 | * | 4/1996 | ..... G03G 9/08 |
| JP | 2011-203511 | A | 10/2011 | |

(Continued)

OTHER PUBLICATIONS

Translation of JP 08-087127 obtained from J-Plat Pat., https://www.j-platpat.inpit.go.jp/p0000.*
U.S. Appl. No. 17/210,961, Kazuki Murata, filed Mar. 24, 2021.
U.S. Appl. No. 17/210,974, Shin Kitamura, filed Mar. 24, 2021.
U.S. Appl. No. 17/334,192, Takakuni Kobori, filed May 28, 2021.
U.S. Appl. No. 17/344,544, Takakuni Kobori, filed Jun. 10, 2021.

*Primary Examiner* — Peter L Vajda
(74) *Attorney, Agent, or Firm* — Venable LLP

(57) ABSTRACT

A toner including a toner particle comprising a binder resin and a crystalline polyester, wherein the binder resin contains a polyester having a structure represented by the following formula (1):

(1)

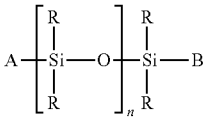

in formula (1), Rs each independently represent hydrogen, a methyl group, or a phenyl group;

A represents a polyester segment;

B represents a polyester segment or any functional group selected from the group consisting of —$R^1$OH, —$R^1$COOH,

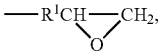

and —$R^1NH_2$ wherein $R^1$ represents a single bond or a $C_{1-4}$ alkylene group; and the average repeat number n is 10 to 80.

6 Claims, No Drawings

(56) References Cited

U.S. PATENT DOCUMENTS

| | | | |
|---|---|---|---|
| 8,603,712 | B2 | 12/2013 | Aoki et al. |
| 8,921,023 | B2 | 12/2014 | Baba et al. |
| 8,927,188 | B2 | 1/2015 | Naka et al. |
| 8,945,805 | B2 | 2/2015 | Baba et al. |
| 8,974,994 | B2 | 3/2015 | Kamae et al. |
| 8,986,914 | B2 | 3/2015 | Fujikawa et al. |
| 9,034,551 | B2 | 5/2015 | Endo et al. |
| 9,058,924 | B2 | 6/2015 | Komatsu et al. |
| 9,063,443 | B2 | 6/2015 | Ishigami et al. |
| 9,097,998 | B2 | 8/2015 | Yamazaki et al. |
| 9,128,400 | B2 | 9/2015 | Takahashi et al. |
| 9,158,217 | B2 | 10/2015 | Takahashi et al. |
| 9,372,420 | B2 | 6/2016 | Mizo et al. |
| 9,417,540 | B2 | 8/2016 | Hashimoto et al. |
| 9,436,112 | B2 | 9/2016 | Iwasaki et al. |
| 9,454,094 | B2 | 9/2016 | Tsujimoto et al. |
| 9,500,975 | B2 | 11/2016 | Sugahara et al. |
| 9,599,920 | B2 | 3/2017 | Sugahara et al. |
| 9,606,466 | B2 | 3/2017 | Takahashi et al. |
| 9,665,021 | B2 | 5/2017 | Ohtsu et al. |
| 9,665,023 | B2 | 5/2017 | Kamae et al. |
| 9,665,026 | B2 | 5/2017 | Iwasaki et al. |
| 9,671,707 | B2 | 6/2017 | Minagawa et al. |
| 9,703,216 | B2 | 7/2017 | Tsuchida et al. |
| 9,778,598 | B2 | 10/2017 | Onozaki et al. |
| 9,785,070 | B2 | 10/2017 | Sugahara et al. |
| 9,823,595 | B2 | 11/2017 | Toyoizumi et al. |
| 9,915,885 | B2 | 3/2018 | Katsumata et al. |
| 9,958,809 | B2 | 5/2018 | Sugahara et al. |
| 9,969,834 | B2 | 5/2018 | Ohtsu et al. |
| 9,996,019 | B1 | 6/2018 | Wang |
| 10,007,206 | B2 | 6/2018 | Sugahara et al. |
| 10,012,918 | B2 | 7/2018 | Ishigami et al. |
| 10,012,921 | B2 | 7/2018 | Kamae et al. |
| 10,036,970 | B2 | 7/2018 | Kanno et al. |
| 10,078,280 | B2 | 9/2018 | Aoki et al. |
| 10,133,201 | B2 | 11/2018 | Kamae et al. |
| 10,146,146 | B2 | 12/2018 | Komatsu et al. |
| 10,175,595 | B2 | 1/2019 | Onozaki et al. |
| 10,197,936 | B2 | 2/2019 | Onozaki et al. |
| 10,216,108 | B2 | 2/2019 | Iwasaki et al. |
| 10,234,777 | B2 | 3/2019 | Ohtsu et al. |
| 10,401,748 | B2 | 9/2019 | Hashimoto et al. |
| 10,409,188 | B2 | 9/2019 | Sugahara et al. |
| 10,423,090 | B2 | 9/2019 | Ohtsu et al. |
| 10,451,985 | B2 | 10/2019 | Takahashi et al. |
| 10,451,986 | B2 | 10/2019 | Sano et al. |
| 10,474,049 | B2 | 11/2019 | Onozaki et al. |
| 10,551,759 | B2 | 2/2020 | Watanabe et al. |
| 10,642,178 | B2 | 5/2020 | Yamashita et al. |
| 10,747,132 | B2 | 8/2020 | Takahashi et al. |
| 10,768,543 | B2 | 9/2020 | Tsujimoto et al. |
| 10,775,710 | B1 | 9/2020 | Kamae et al. |
| 10,838,317 | B2 | 11/2020 | Sugahara et al. |
| 10,859,936 | B2 | 12/2020 | Sugahara et al. |
| 10,877,391 | B2 | 12/2020 | Matsuo et al. |
| 2010/0028796 | A1 | 2/2010 | Nakamura et al. |
| 2010/0183971 | A1 | 7/2010 | Fujikawa et al. |
| 2012/0214097 | A1 | 8/2012 | Naka et al. |
| 2013/0122414 | A1 | 5/2013 | Aoki |
| 2013/0244159 | A1 | 9/2013 | Ishigami et al. |
| 2013/0252167 | A1 | 9/2013 | Moribe et al. |
| 2013/0309603 | A1 | 11/2013 | Takahashi et al. |
| 2014/0134535 | A1 | 5/2014 | Baba et al. |
| 2014/0137428 | A1 | 5/2014 | Takenaka et al. |
| 2016/0109819 | A1 | 4/2016 | Nagasawa |
| 2017/0003612 | A1 | 1/2017 | Toyoizumi |
| 2017/0363979 | A1 | 12/2017 | Aoki |
| 2018/0031988 | A1* | 2/2018 | Toyoizumi ..... G03G 9/08797 |
| 2018/0275540 | A1 | 9/2018 | Matsuo et al. |
| 2018/0314176 | A1 | 11/2018 | Ikeda et al. |
| 2020/0192233 | A1 | 6/2020 | Takahashi et al. |
| 2020/0409284 | A1 | 12/2020 | Matsubara et al. |
| 2020/0409285 | A1 | 12/2020 | Tokunaga et al. |
| 2021/0063903 | A1 | 3/2021 | Shibata et al. |
| 2021/0080848 | A1 | 3/2021 | Tsuchida et al. |

FOREIGN PATENT DOCUMENTS

| | | | |
|---|---|---|---|
| JP | 2013-137496 | A | 7/2013 |
| JP | 2015-36723 | A | 2/2015 |
| JP | 2016-80934 | A | 5/2016 |
| JP | 2016-126331 | A | 7/2016 |
| JP | 2017-16108 | A | 1/2017 |
| JP | 2017-227883 | A | 12/2017 |

* cited by examiner

TONER

CROSS-REFERENCE TO RELATED APPLICATIONS

This application is a Continuation of International Patent Application No. PCT/JP2020/038024, filed Oct. 7, 2020, which claims the benefit of Japanese Patent Application No. 2019-184657, filed Oct. 7, 2019, both of which are hereby incorporated by reference herein in their entirety.

BACKGROUND OF THE INVENTION

Field of the Invention

The present invention relates to the toner for development of the electrostatic image used in, for example, electrophotographic methods and electrostatic recording methods.

Description of the Related Art

Electrophotography-based full-color copiers have become widely disseminated in recent years and have even begun to be employed in the printing market. The printing market requires high speeds, high image qualities, and high productivities, while accommodating a broad range of media (paper types). For example, even when the paper type changes from thick paper to thin paper, a uniform media speed performance is required to enable printing to continue without carrying out a paper type-adaptive change in the process speed or change in the heating temperature set at the fixing unit. In order to accommodate a uniform media speed performance, the toner must support a suitable completion of fixing over a broad range of fixation temperatures from low temperatures to high temperatures. In order to achieve thorough fixing over a broad fixation temperature range, various investigations have been carried out into improving the low-temperature fixing capability through the addition to the toner of a sharp-meltable crystalline polyester to bring about operation as a plasticizer for the binder resin. Various investigations have also been carried out into improving the toner storability, which is a problem associated with this.

For example, Japanese Patent Application Laid-open No. 2015-036723 discloses a toner that has an improved low-temperature fixability brought about by miscibilizing a crystalline polyester resin in an amorphous polyester resin, and that has an improved toner storability brought about by forming a shell on the toner surface.

On the other hand, storability of the image on the printed material is also regarded as critical in the printing market. In the case of an image formed by a toner that exhibits a good low-temperature fixability, even if the toner exhibits a good storability, due to softening of the fixed image the printed material can stick to itself when held in a high-temperature environment. When the adhered printed material is peeled, uneven gloss may be produced and the image may undergo detachment. Japanese Patent Application Laid-open No. 2016-080934 discloses a toner for which, in order to improve both the low-temperature fixability and the image storability, the compatibility between a crystalline polyester and amorphous polyester is controlled.

SUMMARY OF THE INVENTION

The toner described in Japanese Patent Application Laid-open No. 2015-036723 does exhibit a good toner storability; however, the image storability is unsatisfactory due to softening of the image post-fixing. Due to a constitution in which compatibility between the amorphous polyester and crystalline polyester is suppressed, the toner described in Japanese Patent Application Laid-open No. 2016-080934 exhibits an unsatisfactory low-temperature fixability when the image storability is improved. Moreover, while the image storability is shown to be good at a temperature of 30° C. and a humidity of 60% RH, high temperatures above the outside air temperature may occur—depending on the loading location—during transport of the printed material by, for example, vehicle or ship, and there is thus still room for improvement in the image storability. The present invention provides a toner that exhibits an excellent low-temperature fixability and an excellent image storability.

The present invention relates to a toner comprising a toner particle comprising a binder resin and a crystalline polyester, wherein the binder resin contains a polyester having the structure represented by the following formula (1).

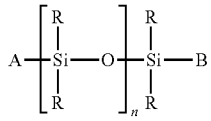

(1)

In formula (1), Rs each independently represent hydrogen, a methyl group, or a phenyl group; A represents a polyester segment; B represents a polyester segment or any functional group selected from the group consisting of —$R^1$OH, —$R^1$COOH,

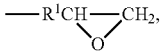

and —$R^1NH_2$ wherein $R^1$ represents a single bond or a $C_{1-4}$ alkylene group; and the average repeat number n is 10 to 80.

The present invention can thus provide a toner that exhibits an excellent low-temperature fixability and an excellent image storability. Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer to numerical value ranges that include the lower limit and upper limit that are the end points. When numerical value ranges are provided in stages, the upper limits and lower limits of the individual numerical value ranges may be combined in any combination.

The present inventors carried out intensive investigations with the goal of achieving additional improvements in the low-temperature fixability and the image storability. It was discovered as a result that an excellent low-temperature fixability and an excellent image storability are obtained by using toner that contains a crystalline polyester and a binder resin that contains polyester having the structure given by the following formula (1).

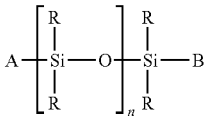

(1)

In formula (1), Rs each independently represent hydrogen, a methyl group, or a phenyl group; A represents a polyester segment; B represents a polyester segment or any functional group selected from the group consisting of —$R^1$OH, —$R^1$COOH,

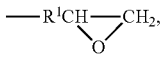

and —$R^1NH_2$ wherein $R^1$ represents a single bond or a $C_{1-4}$ alkylene group; and the average repeat number n is 10 to 80.

The reasons for the appearance of the aforementioned effects when this construction is adopted for the toner are thought to be as follows. Within the structure given by formula (1), the structure excluding A and B is also referred to as a silicone structure. A polyester having the structure given by formula (1) is a resin that has, within the same molecule, both a high-polarity polyester segment and a low-polarity silicone structure. The crystalline polyester exhibits a high compatibility with the polyester segment of the polyester having the structure with formula (1), and due to this it exhibits a plasticizing effect during fixing and the low-temperature fixability is then excellent. On the other hand, the crystalline polyester exhibits a low compatibility with the silicone structure, and it is thought that due to this, recrystallization of the crystalline polyester—which is present in a state in which it is surrounded by the polyester having the structure with formula (1)—is promoted in the temperature region below the melting point. It is thought that as a result, softening of the fixed image can be suppressed and recrystallized crystalline polyester will also be present at a portion of the surface of the fixed image.

The recrystallized crystalline polyester (crystalline portion) has a high heat resistance and improves the image storability; in addition to this, the segment (amorphous portion) other than the crystalline polyester in the fixed image also has a low surface free energy because it contains the silicone structure. It is thought that as a result, the crystalline portion and the amorphous portion can both suppress adhesion between fixed images and the image storability is further improved. Based on the preceding, a heretofore unavailable excellent low-temperature fixability and excellent image storability are obtained through the use of toner that contains crystalline polyester and polyester having the structure given by formula (1).

The glass transition temperature of the toner measured by differential scanning calorimetry in a second heating-up step is preferably from 45° C. to 60° C. and more preferably from 50° C. to 55° C. A better low-temperature fixability and a better image storability are provided by having the glass transition temperature (also referred to simply as Tg in the following) of the toner be within the indicated range.

Using ΔH1 for the endothermic quantity originating with the crystalline polyester in a first heating-up step measured on the toner by differential scanning calorimetry, and using ΔH2 for the endothermic quantity originating with the crystalline polyester in a second heating-up step measured on the toner by differential scanning calorimetry, ΔH1 is preferably from 0.5 J/g to 15.0 J/g, more preferably from 1.0 J/g to 10.0 J/g, still more preferably from 2.0 J/g to 8.0 J/g, and particularly preferably from 3.0 J/g to 7.0 J/g. ΔH2 is preferably from 0.2 J/g to 10.0 J/g, more preferably from 0.5 J/g to 10.0 J/g, still more preferably from 1.5 J/g to 8.0 J/g, and particularly preferably from 2.0 J/g to 5.3 J/g.

In addition, the ratio of ΔH2 to ΔH1 (ΔH2/ΔH1) is preferably from 0.50 to 1.00, more preferably from 0.60 to 1.00, and still more preferably from 0.70 to 1.00. ΔH1 is a value that represents the amount of toner-incorporated crystalline polyester that is present in the crystalline state. (ΔH2/ΔH1), on the other hand, is an index that represents the proportion of crystalline polyester that is recrystallized after fixing. By having ΔH1 and (ΔH2/ΔH1) reside in the indicated ranges, the highly heat-resistant crystalline portion can be effectively obtained at the surface of the fixed image and the image storability is then further improved.

The melting point of the crystalline polyester is preferably from 65° C. to 85° C. and is more preferably from 70° C. to 80° C. By having the melting point of the crystalline polyester reside in the indicated range, the crystalline polyester will have a crystalline structure during image storage, and due to this the image storability is further improved. On the other hand, during fixing, miscibilization occurs with the polyester segment present in the binder resin and a plasticizing effect is exhibited. The low-temperature fixability is further improved as a result.

The glass transition temperature (Tg) of the binder resin, the melting point of the crystalline polyester, the glass transition temperature (Tg) of the toner, and the endothermic quantities ΔH1 and ΔH2 originating with the crystalline polyester are measured using the following method. That is, measurement is carried out based on ASTM D 3418-82 using the following conditions and an MDSC-2920 (TA Instruments) differential scanning calorimeter (DSC).

First, approximately 3 mg of the measurement sample is precisely weighed out and introduced into an aluminum pan; an empty aluminum pan is used for reference. From 30° C. to 200° C. is used as the measurement temperature range; the temperature is raised from 30° C. to 200° C. at a ramp rate of 10° C./min; and cooling is then carried out from 200° C. to 30° C. at a ramp down rate of 10° C./min. The temperature is subsequently raised again from 30° C. to 200° C. at a ramp rate of 10° C./min. Using the curve for the change in the specific heat (i.e., the DSC curve) obtained in this second heating-up step, the glass transition temperature (Tg) is taken to be the temperature at the point of intersection between the curve segment for the step-shaped change at the glass transition, and a straight line that is equidistant in the vertical axis direction from the straight lines that respectively extend the baseline prior to the appearance of the change in specific heat and the baseline after the appearance of the change in specific heat.

The melting point of the crystalline polyester is taken to be the peak temperature of the maximum endothermic peak in the curve for the specific heat change obtained in the second heating-up step. The endothermic quantities ΔH1 and ΔH2 originating with the crystalline polyester are determined by calculation, using the analytical software provided with the instrument, from the peak areas of the endothermic peaks originating with the crystalline polyester. When the crystalline polyester-originating endothermic peak is not overlapped with an endothermic peak for another crystalline material, e.g., wax, the obtained endothermic quantity ΔH is then as such treated as the endothermic quantity ΔH originating with the crystalline polyester. When, on the other hand, an endothermic peak for another crystalline material, e.g., wax, overlaps with the endothermic peak for the crystalline polyester, the endothermic quantity originating with the crystalline material other than the crystalline polyester must be subtracted from the obtained endothermic quantity.

For example, the endothermic quantity originating with the crystalline polyester can be obtained by subtracting the wax-derived endothermic quantity using the following method. DSC measurement is first separately carried out on the wax itself to determine the endothermic characteristics. The wax content in the toner is then determined. There are no particular limitations on the measurement of the wax content in the toner, but, for example, this measurement can be carried out by peak separation in a DSC measurement or by a known structural analysis. The endothermic quantity originating with the wax may then be calculated from the wax content in the toner, and this quantity may be subtracted from the endothermic quantity for the toner. When the wax readily compatibilizes with the resin component, the wax content may be multiplied by a compatibility ratio followed by calculation of the wax-derived endothermic quantity and subtraction thereof. This compatibility ratio may be calculated as the value provided by dividing the endothermic quantity determined for a mixture at a prescribed ratio of the wax and a melt-mixture of the resin component, by the theoretical endothermic quantity calculated from the preliminarily determined endothermic quantity for the melt-mixture and the endothermic quantity for the wax itself.

The content of the crystalline polyester in the toner, per 100 mass parts of the binder resin, is preferably from 2.0 mass parts to 12.0 mass parts and is more preferably from 3.0 mass parts to 8.0 mass parts. By having the crystalline polyester content be in the indicated range, a plasticizing action can be effectively obtained during fixing and the low-temperature fixability is then made better; in addition, the highly heat-resistant crystalline portion can be effectively obtained at the surface of the fixed image and the image storability is then made better.

The content of the silicone structure in the polyester having the structure with formula (1) is preferably from 0.5 mass % to 5.0 mass % and is more preferably from 2.0 mass % to 4.0 mass %. By having the content of the structure with formula (1) be in the indicated range, the surface free energy of the amorphous portion of the fixed image is effectively lowered; in addition, recrystallization of the crystalline polyester can be effectively promoted. Moreover, inhibition of the plasticizing action by the crystalline polyester for the polyester segment is not present, and due to this the image storability and low-temperature fixability are made better.

The binder resin should contain polyester having the structure given by formula (1), and may contain other resin. This other resin can be exemplified by polyester that does not have the structure given by formula (1), vinyl copolymer resins, polyurethane, epoxy resins, phenolic resins, and hybrid resins provided by chemical bonding between two or more types of these resin structures. The polyester segment in the polyester having the formula (1) structure is preferably an amorphous polyester. The content in the binder resin of the polyester having the formula (1) structure should be at least 50 mass % and may be at least 60 mass %, at least 70 mass %, at least 80 mass %, at least 90 mass %, or 100 mass %. The upper limit is equal to or less than 100 mass %. The above-described interaction with the crystalline polyester can be more effectively obtained by having the content in the binder resin of the polyester having the formula (1) structure be at least 50 mass %.

The components constituting the polyester segment of the polyester having the formula (1) structure will now be described. A single species or two or more species of the various following components can be used depending on the type and use. The dibasic acid component constituting the polyester segment can be exemplified by the following dicarboxylic acids and their derivatives: benzenedicarboxylic acids and their anhydrides and lower alkyl esters, e.g., phthalic acid, terephthalic acid, isophthalic acid, and phthalic anhydride; alkyl dicarboxylic acids, e.g., succinic acid, adipic acid, sebacic acid, and azelaic acid, and their anhydrides and lower alkyl esters; alkenylsuccinic acids and alkylsuccinic acids having an average value for the number of carbons of from 1 to 50, and their anhydrides and lower alkyl esters; and unsaturated dicarboxylic acids, e.g., fumaric acid, maleic acid, citraconic acid, and itaconic acid, and their anhydrides and lower alkyl esters. The alkyl group in the lower alkyl esters can be exemplified by the methyl group, ethyl group, propyl group, and isopropyl group.

The dihydric alcohol component constituting the polyester segment, on the other hand, can be exemplified by the following: ethylene glycol, polyethylene glycol, 1,2-propanediol, 1,3-propanediol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexanedimethanol (CHDM), hydrogenated bisphenol A, bisphenols given by formula (I-1) and derivatives thereof, and diols given by formula (I-2).

(I-1)

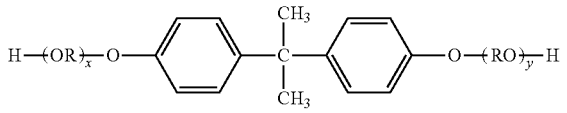

In formula (I-1), R represents the ethylene group or propylene group, x and y are each integers equal to or greater than 0, and the average value of x+y is from 0 to 10.

(I-2)

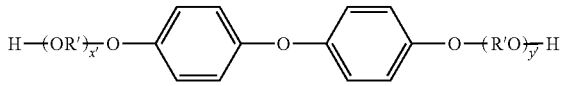

In formula (I-2), R' represents the ethylene group or propylene group, x' and y' are each integers equal to or greater than 0, and the average value of x'+y' is from 0 to 10.

In addition to the aforementioned dibasic carboxylic acid compound and dihydric alcohol compound, the constituent components of the polyester segment may include an at least tribasic carboxylic acid compound and an at least trihydric alcohol compound as constituent components. The at least tribasic carboxylic acid compound is not particularly limited and can be exemplified by trimellitic acid, trimellitic anhydride, and pyromellitic acid. The at least trihydric alcohol compound can be exemplified by trimethylolpropane, pentaerythritol, and glycerol.

In addition to the aforementioned compounds, the constituent components of the polyester segment may include a monobasic carboxylic acid compound and a monohydric alcohol compound as constituent components. Specifically, the monobasic carboxylic acid compound can be exemplified by palmitic acid, stearic acid, arachidic acid, and behenic acid. Additional examples are cerotic acid, heptacosanoic acid, montanic acid, melissic acid, lacceric acid, tetracontanoic acid, and pentacontanoic acid. The monohydric alcohol compound can be exemplified by behenyl alcohol, ceryl alcohol, melissyl alcohol, and tetracontanol.

A description is provided in the following of the components constituting the structure (i.e., a silicone structure) provided by removing A and B from the structure given by formula (1) in the polyester having the structure given by formula (1). A single species or two or more species of the various following components can be used depending on the type and use. The silicone structure has the structure given by the following formula (2).

(2)

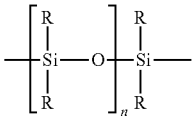

In formula (2), Rs each independently represent hydrogen, a methyl group, or a phenyl group, and n is from 10 to 80. This n is the average value of the number of repetitions of the siloxane unit and is preferably from 20 to 65.

The occurrence of an excellent diffusibility into the binder resin is facilitated by having the value of n be in the indicated range. It is thought that as a consequence an effective recrystallization of the crystalline polyester is facilitated and a lowering of the surface free energy is facilitated and the image storability is then made better. Preferably all of the R's in formula (1) are the methyl group. Having all of the R's be the methyl group supports a greater promotion of recrystallization of the crystalline polyester and provides a greater improvement in the image storability.

Silicone oil that has, at a terminal or terminals in formula (2), a functional group that chemically reacts with the polyester may be used as a component that forms the formula (2) structure in the polyester having the formula (1) structure. This functional group that reacts with the polyester can be exemplified by the hydroxy group, carboxy group, epoxy group, and amino group. From the standpoint of controlling the reactivity with the polyester, the hydroxy group or carboxy group is preferably used for the terminal functional group in the silicone oil. 1, 2, or 3 or more can be used for the number of functional groups at the silicone oil terminal or terminals. In order to provide a better image storability through control of the compatibility with the crystalline polyester through the introduction of the silicone structure into the main skeleton of the polyester, the use is preferred of a silicone oil having a functional group at both terminals of the silicone oil. Specific examples are silicone oils having the hydroxy group at both terminals (KF-6000, KF-6001, and KF-6002, all from Shin-Etsu Chemical Co., Ltd.).

The method for producing the polyester having the formula (1) structure is not particularly limited and a known method can be used. For example, the polyester having the formula (1) structure may be produced by the polymerization—via an esterification reaction or transesterification reaction and a condensation reaction—of the aforementioned dibasic carboxylic acid compound, dihydric alcohol compound, and functional group-terminated silicone oil. The polymerization temperature is not particularly limited, but the range from 180° C. to 290° C. is preferred. For example, a polymerization catalyst, e.g., a titanium catalyst, tin catalyst, zinc acetate, antimony trioxide, germanium dioxide, and so forth, can be used during polymerization to give the polyester.

The softening point (also referred to hereafter simply as Tm) of the polyester having the formula (1) structure is preferably from 85° C. to 150° C. and is more preferably from 100° C. to 150° C. By having the softening point of the polyester having the formula (1) structure be in the indicated range, the image storability of the fixed image is further enhanced and in addition the low-temperature fixability also becomes excellent. The glass transition temperature (Tg) of the polyester having the formula (1) structure, in a second heating-up step in measurement by differential scanning calorimetry as described above, is preferably from 50° C. to 65° C. and is more preferably from 53° C. to 60° C.

The softening point (Tm) is measured proceeding as follows. The softening point is measured using a "Flowtester CFT-500D Flow Property Evaluation Instrument" (Shimadzu Corporation), which is a constant-load extrusion-type capillary rheometer, in accordance with the manual provided with the instrument. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature can be obtained from this. The "melting temperature by the ½ method", as described in the manual provided with the "Flowtester CFT-500D Flow Property Evaluation Instrument", is used as the softening point in the present disclosure.

The melting temperature by the ½ method is determined as follows. First, ½ of the difference between the piston stroke Smax at the completion of outflow and the piston stroke Smin at the start of outflow is determined (this value is designated as X, where X=(Smax−Smin)/2). The temperature in the flow curve when the piston stroke in the flow curve reaches the sum of X and Smin is the melting temperature by the ½ method. The measurement sample used is prepared by subjecting approximately 1.3 g of the sample to compression molding for 60 seconds at 10 MPa in a 25° C. environment using a tablet compression molder (for example, NT-100H, NPa System Co., Ltd.) to provide a cylindrical shape with a diameter of approximately 8 mm. The measurement conditions with the CFT-500D are as follows.

test mode: ramp-up method
start temperature: 50° C.
saturated temperature: 200° C.
measurement interval: 1.0° C.
ramp rate: 4.0° C./min
piston cross section area: 1.000 $cm^2$
test load (piston load): 10.0 $kgf/cm^2$ (0.9807 MPa)
preheating time: 300 seconds
diameter of die orifice: 1.0 mm
die length: 1.0 mm The toner particle contains crystalline polyester. In the present disclosure, a crystalline polyester is a polyester for which an endothermic peak is observed during measurement by differential scanning calorimetry (DSC). Due to the requirement for ease of molecular motion in order to assume a eutectic structure, the crystalline polyester preferably is a crystalline polyester capable of assuming a lamellar structure, i.e., a folded structure. The alcohol component used as starting monomer for the crystalline polyester can be exemplified as follows. Examples are ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, but there is no limitation to these.

Among the preceding, from the standpoint of the low-temperature fixability and the image storability, aliphatic diols having from 6 to 18 carbons are preferred and aliphatic diols having from 8 to 14 carbons are more preferred. From the standpoint of achieving a greater increase in the crystallinity of the crystalline polyester, the aliphatic diol content is preferably a content in the alcohol component of from 80 mol % to 100 mol %.

The alcohol component for obtaining the crystalline polyester may contain a polyhydric alcohol component other than the aliphatic diol described above. Examples here are aromatic diols, e.g., alkylene oxide adducts on bisphenol A, including polyoxypropylene adducts on 2,2-bis(4-hydroxyphenyl)propane and polyoxyethylene adducts on 2,2-bis(4-hydroxyphenyl)propane, as well as at least trihydric alcohols such as glycerol, pentaerythritol, trimethylolpropane.

On the other hand, the carboxylic acid component used as starting monomer for the crystalline polyester can be exemplified by the following: aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid. Additional examples are the anhydrides of the preceding and the lower alkyl esters of the preceding. The alkyl group in the lower alkyl ester can be exemplified by the methyl group, ethyl group, propyl group, and isopropyl group.

Among the preceding, and viewed from the standpoint of the low-temperature fixability and image storability, the use of aliphatic dicarboxylic acid compounds having from 6 to 18 carbons is preferred, and aliphatic dicarboxylic acid compounds having from 6 to 12 carbons are more preferred. The content of the aliphatic dicarboxylic acid compound is preferably a content in the carboxylic acid component of from 80 mol % to 100 mol %.

The carboxylic acid component for obtaining the crystalline polyester may contain a carboxylic acid component other than the aliphatic dicarboxylic acid compounds described above. Examples are aromatic dicarboxylic acid compounds and at least tribasic aromatic polybasic carboxylic acid compounds, but there are no particular limitations to these. Derivatives of aromatic dicarboxylic acids are also encompassed by the aromatic dicarboxylic acid compounds. Preferred specific examples of the aromatic dicarboxylic acid compounds are aromatic dicarboxylic acids such as phthalic acid, isophthalic acid, terephthalic acid, and naphthalene-2,6-dicarboxylic acid, and the anhydrides of these acids and their alkyl (from 1 to 3 carbons) esters. The alkyl group in the alkyl esters can be exemplified by the methyl group, ethyl group, propyl group, and isopropyl group. The at least tribasic polybasic carboxylic acid compounds can be exemplified by 1,2,4-benzenetricarboxylic acid (trimellitic acid), 2,5,7-naphthalenetricarboxylic, and pyromellitic acid and their derivatives such as the anhydrides and alkyl (from 1 to 3 carbons) esters.

The crystalline polyester preferably is a polycondensate of an aliphatic diol having from 6 to 18 carbons with an aliphatic dicarboxylic acid compound having from 6 to 18 carbons. A polycondensate of an aliphatic diol having from 8 to 14 carbons with an aliphatic dicarboxylic acid compound having from 6 to 12 carbons is more preferred. The molar ratio between the alcohol component and carboxylic acid component that are the starting monomers for the crystalline polyester (carboxylic acid component/alcohol component) is preferably from 0.80 to 1.20. The weight-average molecular weight of the crystalline polyester is preferably from $1.0\times10^4$ to $1.0\times10^5$ and is more preferably from $2.0\times10^4$ to $5.0\times10^4$.

The weight-average molecular weight of the crystalline polyester is measured using gel permeation chromatography (GPC) as follows. First, 50 mg of sample is introduced into 5 mL of chloroform; standing is carried out for several hours at 25° C.; thorough shaking is then performed to achieve thorough mixing with the chloroform; and standing is carried out for at least an additional 24 hours until aggregates of the sample are not present. The resulting solution is filtered across a "Pretreatment Cartridge H-25-5" solvent-resistant membrane filter having a pore diameter of 0.5 μm to obtain a sample solution. The measurement is performed using this sample solution and the following conditions.

instrument: "Lab Solutions GPC" high-performance GPC instrument (Shimadzu Corporation)
column: PLgel 5 μm MIXED-C 300 mm×7.5 mm (Agilent Technologies, Inc.): 2; PLgel 5 μm Guard 50 mm×7.5 mm (Agilent Technologies, Inc.): 1
eluent: chloroform
flow rate: 1.0 mL/min
oven temperature: 45° C.
sample injection amount: 60 μL
detector: RI (refractive index) detector The weight-average molecular weight (Mw) of the sample is determined using a molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation).

The toner may be used in the form of a magnetic single-component toner, a nonmagnetic single-component toner, or a nonmagnetic two-component toner. When the toner is used in the form of a magnetic single-component toner, a magnetic body is preferably used as a colorant. The magnetic body contained in the magnetic single-component toner can be exemplified by magnetic iron oxides such as magnetite, maghemite, ferrite, and magnetic iron oxides that contain another metal oxide, and by metals such as Fe, Co, and Ni, alloys of these metals with a metal such as Al, Co, Cu, Pb, Mg, Ni, Sn, Zn, Sb, Be, Bi, Cd, Ca, Mn, Se, Ti, W, and V, and mixtures of the preceding. The magnetic body content is preferably from 30 mass parts to 150 mass parts per 100 mass parts of the binder resin.

Examples of the colorant are provided below in the case of use in the form of a nonmagnetic single-component toner or a nonmagnetic two-component toner. Carbon black, e.g., furnace black, channel black, acetylene black, thermal black, and lamp black, may be used as a black pigment, as can magnetic bodies such as magnetite and ferrite.

A pigment or dye may be used as a colorant suitable for the color yellow. The pigments can be exemplified by C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191, and C. I. Vat Yellow 1, 3, and 20. The dyes can be exemplified by C. I. Solvent Yellow 19, 44, 77, 79, 81, 82, 93, 98, 103, 104, 112, and 162. A single one of these may be used by itself or two or more may be used in combination.

A pigment or dye may be used as a colorant suitable for the color cyan. The pigments can be exemplified by C. I. Pigment Blue 1, 7, 15, 15:1, 15:2, 15:3, 15:4, 16, 17, 60, 62, and 66; C. I. Vat Blue 6; and C. I. Acid Blue 45. The dyes can be exemplified by C. I. Solvent Blue 25, 36, 60, 70, 93, and 95. A single one of these may be used by itself or two or more may be used in combination.

A pigment or dye may be used as a colorant suitable for the color magenta. The pigments can be exemplified by C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, and 254; C. I. Pigment Violet 19; and C. I. Vat Red 1, 2, 10, 13, 15, 23, 29, and 35. Magenta dyes can be exemplified by the following: oil-soluble dyes such as C. I. Solvent Red 1, 3, 8, 23, 24, 25, 27, 30, 49, 52, 58, 63, 81, 82, 83, 84, 100, 109, 111, 121, and 122; C. I. Disperse Red 9; C. I. Solvent Violet 8, 13, 14, 21, and 27; and C. I. Disperse Violet 1, and by basic dyes such as C. I. Basic Red 1, 2, 9, 12, 13, 14, 15, 17, 18, 22, 23, 24, 27, 29, 32, 34, 35, 36, 37, 38, 39, and 40 and C. I. Basic Violet 1, 3, 7, 10, 14, 15, 21, 25, 26, 27, and 28. A single one of these may be used by itself or two or more may be used in combination. The colorant content is preferably from 1 mass parts to 20 mass parts per 100 mass parts of the binder resin.

The toner particle may contain a release agent (wax) in order to confer releasability. This wax can be exemplified by the following. Examples are aliphatic hydrocarbon waxes such as low molecular weight polyethylene, low molecular weight polypropylene, olefin copolymers, microcrystalline wax, paraffin wax, and Fischer-Tropsch wax; oxidized waxes from aliphatic hydrocarbon waxes, e.g., oxidized polyethylene wax; waxes in which the main component is a fatty acid ester, e.g., carnauba wax, behenyl behenate, and montanic acid ester wax; and waxes provided by the partial or complete deacidification of a fatty acid ester, e.g., deacidified carnauba wax. Additional examples are saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; aliphatic metal salts (generally known as metal soaps) such as calcium stearate, calcium laurate, zinc stearate, and magnesium stearate; waxes provided by grafting an aliphatic hydrocarbon wax using a vinyl copolymer monomer such as styrene or acrylic acid; partial esters between a fatty acid and a polyhydric alcohol, such as behenyl monoglyceride; and hydroxy group-containing methyl ester compounds obtained by, e.g., the hydrogenation of plant oils.

Aliphatic hydrocarbon waxes are waxes preferred for use among the preceding. Examples are low molecular weight hydrocarbons provided by the high-pressure radical polymerization of alkylene or by the low-pressure polymerization of alkylene in the presence of a Ziegler or metallocene catalyst; Fischer-Tropsch waxes synthesized from coal or natural gas; olefin polymers obtained by the pyrolysis of high molecular weight olefin polymers; and synthetic hydrocarbon waxes obtained from the distillation residue of hydrocarbon obtained by the Arge method from synthesis gas containing carbon monoxide and hydrogen, as well as the synthetic hydrocarbon waxes provided by the hydrogenation of such synthetic hydrocarbon waxes. Additional examples are waxes provided by the fractionation of hydrocarbon waxes using a press sweating method, solvent method, vacuum distillation, or fractional crystallization method. Waxes synthesized by a method not involving alkylene polymerization are also particularly preferred in terms of their molecular weight distribution. With regard to the timing of wax addition, the wax may be added during production of the toner or may be added during production of the binder resin. A single species of these waxes may be used by itself or two or more species may be used in combination. The wax content is preferably from 1 mass parts to 20 mass parts per 100 mass parts of the binder resin.

A heretofore known charge control agent may be used as a charge control agent in the toner particle. The heretofore known charge control agents can be exemplified by azo-iron compounds, azo-chromium compounds, azo-manganese compounds, azo-cobalt compounds, azo-zirconium compounds, chromium compounds of carboxylic acid derivatives, zinc compounds of carboxylic acid derivatives, aluminum compounds of carboxylic acid derivatives, and zirconium compounds of carboxylic acid derivatives. Aromatic hydroxycarboxylic acids are preferred for the carboxylic acid derivatives. Charge control resins may also be used. Two or more charge control agents may be used in combination as necessary. The content of the charge control agent is preferably from 0.1 mass parts to 10 mass parts per 100 mass parts of the binder resin.

The toner may be used in the form of a two-component developer as provided by mixing with a carrier. An ordinary carrier, e.g., of ferrite, magnetite, and so forth, or a resin-coated carrier may be used as the carrier. Also usable are binder-type carriers in which a magnetic body is dispersed in a resin. The resin-coated carrier is composed of a carrier core particle and a coating material, which is a resin that coats the surface of the carrier core particle. The resin used for the coating material can be exemplified by styrene-acrylic resins, e.g., styrene-acrylate ester copolymers and styrene-methacrylate ester copolymers; acrylic resins such as acrylate ester copolymers and methacrylate ester copolymers; fluororesins such as polytetrafluoroethylene, monochlorotrifluoroethylene polymer, and polyvinylidene fluoride; silicone resins; polyester resins; polyamide resins; polyvinyl butyral; and aminoacrylate resins. Ionomer resins and polyphenylene sulfide resins are additional examples. A single one of these resins may be used or a plurality may be used.

The toner may have an external additive, e.g., silica fine particles, externally added to the toner particle in order to enhance the charge stability, developing performance, flowability, and durability. The silica fine particles preferably have a specific surface area according to the BET method based on nitrogen adsorption of from 30 $m^2/g$ to 500 $m^2/g$ and more preferably from 50 $m^2/g$ to 400 $m^2/g$. The content of the silica fine particles, per 100 mass parts of the toner particle, is preferably from 0.01 mass parts to 8.00 mass parts and is more preferably from 0.10 mass parts to 5.00 mass parts.

The BET specific surface area of the silica fine particles can be determined using the BET multipoint method by carrying out the adsorption of nitrogen gas onto the surface of the silica fine particles using, for example, an Autosorb 1 specific surface area analyzer (Yuasa Ionics Co., Ltd.), Gemini 2360/2375 (Micromeritics Instrument Corporation), or TriStar 3000 (Micromeritics Instrument Corporation). With the goals of enhancing the hydrophobicity and controlling triboelectric charging, as necessary the silica fine particles may be treated with a treatment agent such as an unmodified silicone varnish, silicone varnishes that have been variously modified, unmodified silicone oil, silicone oils that have been variously modified, silane coupling agents, functional group-bearing silane compounds, and other organosilicon compounds, and several different treatment agents may be used in combination.

The toner may optionally contain an external additive other than silica fine particles. The external additive can be exemplified by inorganic fine particles and resin fine particles that function as, for example, a charge adjuvant, conductivity-imparting agent, flowability-imparting agent, anticaking agent, release agent during hot roller fixing, lubricant, or abrasive. The charge adjuvant can be exemplified by metal oxide fine particles such as titanium oxide fine particles, zinc oxide fine particles, and alumina fine particles. The lubricant can be exemplified by polyfluoroethylene powder, zinc stearate powder, and polyvinylidene fluoride powder. The abrasive can be exemplified by cerium oxide powder, silicon carbide powder, and strontium titanate powder.

The method for producing the toner particle is not particularly limited and a known method may be used. Examples are the pulverization method, emulsion aggregation method, suspension polymerization method, and dissolution suspension method. A toner particle produced by the pulverization method may be produced, for example, proceeding as follows. The crystalline polyester, binder resin containing the polyester having the formula (1) structure, and optional colorant, wax, other additives, and so forth are thoroughly mixed using a mixer such as a Henschel mixer or ball mixer. The resulting mixture is melt-kneaded using a heated kneader such as a twin-screw kneader extruder, hot roll, kneader, or extruder. The obtained melt-kneaded material is cooled and solidified and subsequently pulverized and classified to yield a toner particle. During this process, the average circularity of the toner particle can also be controlled through adjustment of the exhaust temperature during fine pulverization. As necessary, a toner can be obtained by mixing the toner particle with an external additive using a mixer such as a Henschel mixer.

The mixer can be exemplified by the following: Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation). The kneader can be exemplified by the following: KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Manufacturing Co., Ltd.); Kneadex (Mitsui Mining Co., Ltd.); Model MS pressure kneader and Kneader-Ruder (Moriyama Mfg. Co., Ltd.); and Banbury mixer (Kobe Steel, Ltd.). The pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

As necessary, pulverization may also be followed by control of the average circularity of the toner particle through the execution of a surface treatment on the toner particle using a Hybridization System (Nara Machinery Co., Ltd.), Nobilta (Hosokawa Micron Corporation), Mechanofusion System (Hosokawa Micron Corporation), Faculty (Hosokawa Micron Corporation), Inomizer (Hosokawa Micron Corporation), Theta Composer (Tokuju Corporation), Mechanomill (Okada Seiko Co., Ltd.), or Meteo Rainbow MR Type (Nippon Pneumatic Mfg. Co., Ltd.).

The classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.). Screening devices that can be used to screen out the coarse particles can be exemplified by the following: Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

The various measurement methods are described in the following.

Method for Measuring the Weight-Average Particle Diameter (D4): The weight-average particle diameter (D4) of the toner or toner particle (also referred to below as, for example, toner) is determined proceeding as follows. The measurement instrument used is a "Coulter Counter Multisizer 3" (registered trademark, Beckman Coulter, Inc.), a precision particle size distribution measurement instrument operating on the pore electrical resistance method and equipped with a 100-μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels. The aqueous electrolyte solution used for the measurements is prepared by dissolving special-grade sodium chloride in deionized water to provide a concentration of 1.0% and, for example, "ISOTON II" (Beckman Coulter, Inc.) can be used.

The dedicated software is configured as follows prior to measurement and analysis. In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte solution is set to ISOTON II; and a check is entered for the "post-measurement aperture tube flush". In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm. The specific measurement procedure is as follows.

(1) 200 mL of the aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) Approximately 30 mL of the aqueous electrolyte solution is introduced into a 100 mL flatbottom glass beaker, and to this is added as dispersing agent 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. 3.3 L of deionized water is introduced into the water tank of the ultrasound disperser and 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg of, e.g., the toner, is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the aqueous electrolyte solution prepared in (5), in which, e.g., the toner, is dispersed, is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

Method for Identifying the Polyester Having the Structure Represented by Formula (1): The structure represented by formula (1) is identified using the following method. The hydrocarbon group represented by the R in formula (1) and the silicone structure are identified using $^{13}$C-NMR and solid-state $^{29}$Si-NMR.

$^{13}$C-NMR measurement conditions
instrument: JNM-ECX500II, JEOL RESONANCE
sample tube: 3.2 mmΦ
sample: deuterochloroform-soluble matter from sample for NMR measurement
measurement temperature: room temperature
pulse mode: CP/MAS
measurement nucleus frequency: 123.25 MHz ($^{13}$C)
reference substance: adamantane (external reference: 29.5 ppm)
sample spinning rate: 20 kHz
contact time: 2 ms
delay time: 2 s
number of scans: 1024

In this method, the hydrocarbon group represented by the R in formula (1) is identified by the presence/absence of signal originating with, e.g., the silicon atom-bonded methyl group (Si—$CH_3$) or phenyl group (Si—$C_6H_5$).

The specific measurement conditions for the solid-state $^{29}$Si-NMR are as follows.
instrument: JNM-ECX5002 (JEOL RESONANCE)
temperature: room temperature
measurement method: DD/MAS method, $^{29}$5 i, 45°
sample tube: zirconia 3.2 mmΦ
sample: filled as a powder into the sample tube
sample spinning rate: 10 kHz
relaxation delay: 180 s
scans: 2000

Method for Measuring the Content of the Crystalline Polyester and the Content of the Structure Represented by Formula (2): The content of the crystalline polyester and the content of the structure represented by formula (2) are determined by $^{1}$H-NMR using the instrument described above.

$^{1}$-NMR measurement conditions
sample: deuterochloroform-soluble matter
pulse condition: 5.0 μs
frequency range: 10,500 Hz
number of scans: 64

EXAMPLES

The present disclosure is specifically described herebelow based on production examples, examples, and comparative examples. However, the present disclosure is in no way limited to or by these. Unless specifically indicated otherwise, the "parts" and "%" in the production examples, examples, and comparative examples are on a mass basis in all instances.

Binder Resin 1 Production Example bisphenol A/ethylene oxide (2.2 mol adduct): 50.0 mol parts
bisphenol A/propylene oxide (2.2 mol adduct): 50.0 mol parts
terephthalic acid: 90.0 mol parts
trimellitic anhydride: 10.0 mol parts 97.0 parts of this monomer for forming the polyester segment and 3.0 parts of a silicone oil having the hydroxy group at both terminals (KF-6000, Shin-Etsu Chemical Co., Ltd.) were introduced into a 5-L autoclave along with 500 ppm titanium tetrabutoxide and were mixed. A reflux condenser, water separation device, $N_2$ gas introduction line, thermometer, and stirring device were then installed on the autoclave and a condensation polymerization reaction was run at 230° C. while introducing $N_2$ gas into the autoclave. The reaction time was adjusted to give the desired softening point; completion of the reaction was followed by removal from the vessel, cooling, and pulverization to obtain a polyester 1 having the structure represented by formula (1). This polyester 1 had a softening point (Tm) of 130° C. and a glass transition temperature (Tg) of 55° C. Polyester 1 was designated binder resin 1. The content of the formula (2) structure in the polyester having the formula (1) structure was 3.0 mass %; all of the R in formula (1) was the methyl group; and n was 26.

Binder Resin 2 Production Example: A polyester 2 was obtained according to the Binder Resin 1 Production Example, but changing the silicone oil having the hydroxy group at both terminals to 4.0 parts of a silicone oil (KF-6002, Shin-Etsu Chemical Co., Ltd.). This polyester 2 was designated binder resin 2. The content of the formula (2) structure in the polyester having the formula (1) structure was 4.0 mass %; all of the R in formula (1) was the methyl group; and n was 63.

Binder Resins 3 to 10 Production Example: Polyesters 3 to 10 were obtained according to the Binder Resin 1 Production Example, but changing the silicone oil having the hydroxy group at both terminals to a silicone oil (KF-6001, Shin-Etsu Chemical Co., Ltd.), changing the amount of addition of the silicone oil as shown in Table 1, and adjusting the softening point (Tm) and glass transition temperature (Tg) by adjusting the reaction time. These polyesters 3 to 10 were designated binder resins 3 to 10. All of the R in formula (1) was the methyl group, and n was 38.

TABLE 1

| inder resin No. | polyester No. | amount of silicone oil addition (mass parts) | content of formula (2) structure (mass %) | Tm (° C.) | Tg (° C.) |
|---|---|---|---|---|---|
| 1 | 1 | 3.0 | 3.0 | 130 | 55 |
| 2 | 2 | 4.0 | 4.0 | 128 | 53 |
| 3 | 3 | 2.0 | 2.0 | 136 | 56 |
| 4 | 4 | 0.5 | 0.5 | 135 | 58 |
| 5 | 5 | 5.0 | 5.0 | 143 | 58 |
| 6 | 6 | 6.0 | 6.0 | 140 | 56 |
| 7 | 7 | 0.3 | 0.3 | 135 | 60 |
| 8 | 8 | 0.3 | 0.3 | 125 | 52 |
| 9 | 9 | 0.3 | 0.3 | 150 | 65 |
| 10 | 10 | 0.3 | 0.3 | 135 | 59 |

Binder Resin 11 Production Example: An unmodified polyester 11 was obtained in accordance with the Binder Resin 1 Production Example, but changing the amount of silicone oil addition to 0 and adjusting the softening point (Tm) and glass transition temperature (Tg) by adjusting the reaction time. The unmodified polyester 11 had a softening point (Tm) of 113° C. and a glass transition temperature (Tg) of 44° C. This unmodified polyester 11 was designated binder resin 11.

Binder Resin 12 Production Example: An unmodified polyester 12 was obtained in accordance with the Binder Resin 11 Production Example, but adjusting the softening point (Tm) and glass transition temperature (Tg) by adjusting the reaction time. The unmodified polyester 12 had a softening point (Tm) of 150° C. and a glass transition temperature (Tg) of 65° C. This unmodified polyester 12 was designated binder resin 12.

Crystalline Polyester 1 Production Example: 100.0 mol parts of 1,10-decanedicarboxylic acid as the carboxylic acid monomer and 100.0 mol parts of 1,9-nonanediol as the alcohol monomer were introduced into a reactor fitted with a nitrogen introduction line, water separation tube, stirrer, and thermocouple. The temperature was raised to 140° C. while stirring and a reaction was run for eight hours while heating to 140° C. under a nitrogen atmosphere and distilling out the water under normal pressure. 0.57 parts of tin dioctylate was then added per 100 parts of the total of the carboxylic acid monomer and alcohol monomer, followed by reaction while heating to 200° C. at 10° C./hour. After reaction for two hours after 200° C. had been reached, the pressure in the reactor was lowered to 5 kPa or below, and the reaction was run at 200° C. while monitoring the molecular weight to obtain crystalline polyester 1. Crystalline polyester 1 had a melting point of 75° C. and a weight-average molecular weight of $2.5\times10^4$.

Crystalline Polyester 2 Production Example: Crystalline polyester 2 was obtained proceeding as in the Crystalline Polyester 1 Production Example, but changing the weight-average molecular weight by adjusting the reaction time. Crystalline polyester 2 had a melting point of 75° C. and a weight-average molecular weight of $1.5\times10^4$.

Crystalline Polyester 3 Production Example: Crystalline polyester 3 was obtained proceeding as in the Crystalline Polyester 1 Production Example, but changing the carboxylic acid monomer to sebacic acid and changing the alcohol monomer to 1,4-butanediol. Crystalline polyester 3 had a melting point of 65° C. and a weight-average molecular weight of $1.5\times10^4$.

Toner 1 Production Example binder resin 1 100 parts
crystalline polyester 1 5 parts
Fischer-Tropsch wax (melting point: 90° C.) 6 parts
C. I. Pigment Blue 15:3 4 parts The materials listed above were preliminarily mixed using a Henschel mixer, followed by melt-kneading at 160° C. using a twin-screw kneader extruder. The resulting kneaded material was cooled and coarsely pulverized using a hammer mill and was finely pulverized using a Turbo mill. The obtained finely pulverized material was classified using a Coanda effect-based multi-grade classifier to obtain a negative triboelectric charging toner particle 1 having a weight-average particle diameter (D4) of 6.0 μm. 2.0 parts of hydrophobed silica fine particles (specific surface area of 140 $m^2/g$, measured by the BET method using nitrogen adsorption) was externally added to and mixed with 100 parts of the toner particle 1, and screening across a mesh with an aperture of 150 μm then gave toner 1. Toner 1 had a ΔH1 of 4.9 J/g and a ΔH2 of 3.5 J/g. Toner 1 had a glass transition temperature (Tg), measured by differential scanning calorimetry in the second ramp up step, of 53° C.

Example of Production of Magnetic Core Particles for Use as a Carrier $Fe_2O_3$ 62.7 parts
$MnCO_3$ 29.5 parts
$Mg(OH)_2$ 6.8 parts
$SrCO_3$ 1.0 parts The materials listed above were weighed out as ferrite starting materials in the compositional ratio indicated above. This was followed by mixing and pulverization for five hours using a dry vibrating mill and stainless steel beads having a diameter of ⅛ inch. The resulting pulverized material was converted into approximately 1 mm-square pellets using a roller compactor. Coarse powder was removed from these pellets using a vibrating screen having an aperture of 3 mm; the fines were then removed using a vibrating screen having an aperture of 0.5 mm; and firing was thereafter carried out in a burner-type firing furnace under a nitrogen atmosphere (0.01 volume % oxygen concentration) for four hours at a temperature of 1000° C. to produce a prefired ferrite. The composition of the obtained prefired ferrite was as follows.

$$(MnO)_a(MgO)_b(SrO)_c(Fe_2O_3)_d$$

In the formula, a=0.257, b=0.117, c=0.007, d=0.393.

The obtained prefired ferrite was pulverized with a crusher to about 0.3 mm, followed by the addition of 30 parts of water per 100 parts of the prefired ferrite and pulverization for one hour with a wet ball mill using zirconia beads with a diameter of ⅛ inch. The obtained slurry was pulverized for four hours with a wet ball mill using alumina beads having a diameter of 1/16 inch to obtain a ferrite slurry (fine pulverizate of the prefired ferrite). 1.0 parts of an ammonium polycarboxylate as a dispersing agent and 2.0 parts of polyvinyl alcohol as a binder were added to the ferrite slurry per 100 parts of the prefired ferrite, followed by granulation into spherical particles using a spray dryer (manufacturer: Ohkawara Kakohki Co., Ltd.). The particle size of the obtained particles was adjusted followed by heating for two hours at 650° C. using a rotary kiln to remove the organic component, e.g., the dispersing agent and binder. In order to control the firing atmosphere, the temperature was raised over two hours using an electric furnace from room temperature to a temperature of 1300° C. under a nitrogen atmosphere (1.00 volume % oxygen concentration), and firing was then performed for four hours at a temperature of 1150° C. This was followed by reducing the temperature to a temperature of 60° C. over four hours, returning to the atmosphere from the nitrogen atmosphere, and removal at a temperature of 40° C. or below. The aggregated particles were broken up; the low magnetic force product was then removed using a magnetic force classifier; and the coarse particles were removed by sieving on a sieve with an aperture of 250 μm to obtain magnetic core particles having a 50% particle diameter (D50) on a volume basis of 37.0 μm.

Example of Production of Coating Resin for Use with Carrier cyclohexyl methacrylate monomer 26.8% methyl methacrylate monomer 0.2% methyl methacrylate macromonomer 8.4%

(macromonomer having the methacryloyl group at one terminal and having a weight-average molecular weight of 5,000)

toluene 31.3% methyl ethyl ketone 31.3% azobisisobutyronitrile 2.0%

Of these materials, the cyclohexyl methacrylate monomer, methyl methacrylate monomer, methyl methacrylate macromonomer, toluene, and methyl ethyl ketone were introduced into a four-neck separable flask fitted with a reflux condenser, thermometer, nitrogen introduction line, and stirrer. Nitrogen gas was introduced into the separable flask to thoroughly establish a nitrogen atmosphere, and this was followed by heating to 80° C., the addition of the azobisisobutyronitrile, and polymerization for five hours under reflux. Hexane was poured into the resulting reaction product to precipitate the copolymer. The resulting precipitate was separated by filtration and vacuum dried to obtain a resin. 30 parts of this resin was dissolved in a mixed solvent of 40 parts of toluene and 30 parts of methyl ethyl ketone to obtain a resin solution (solids concentration=30%).

Preparation of Coating Resin Solution resin solution (30% solids concentration) 33.3% toluene 66.4% carbon black (Regal 330, Cabot Corporation) 0.3%

(number-average primary particle diameter: 25 nm, specific surface area by nitrogen adsorption: 94 $m^2/g$, DBP absorption: 75 mL/100 g)

The materials listed above were introduced into a paint shaker and were dispersed for one hour using zirconia beads having a diameter of 0.5 mm. The obtained dispersion was filtered across a 5.0-μm membrane filter to obtain a coating resin solution.

Magnetic Carrier Production Example: The coating resin solution and the magnetic core particles (the amount of introduction of the coating resin solution was 2.5 parts as the resin component per 100 parts of the magnetic core particles) were introduced into a vacuum-degassing kneader being maintained at normal temperature. After the introduction, stirring was performed for 15 minutes at a stirring rate of 30 rpm and the solvent was evaporated by at least a prescribed amount (80 mass %) followed by raising the temperature to 80° C. while mixing under reduced pressure, distilling off the toluene over two hours, and cooling. The low magnetic force product was separated from the resulting magnetic carrier using a magnetic force classifier, and the magnetic carrier was then passed through a sieve having an aperture of 70 μm and classified using a wind force classifier to obtain a magnetic carrier having a 50% particle diameter (D50) on a volume basis of 38.2 μm.

Developer 1 Production Example: A developer 1 was prepared by mixing the toner 1 and magnetic carrier using a V-mixer (Model V-10, Tokuju Seisakusho Co., Ltd.) and conditions of 0.5 $s^{-1}$ and a rotation time of five minutes, and using 10 parts of toner 1 per 90 parts of the magnetic carrier. The following evaluations were carried out using the obtained developer 1.

Example 1: Evaluation of Low-Temperature Fixability: An imageRUNNER ADVANCE C5051, a digital printer for commercial printing from Canon, Inc., was used as the image-forming device; it was modified to enable the fixation temperature and process speed to be freely settable. The developer 1 was introduced into the developing device for the cyan position of this modified machine; the electrostatic latent image bearing member, or the direct current voltage VDC of the developer carrying member, the charging voltage VD of the electrostatic latent image bearing member, and the laser power were adjusted so as to provide the desired toner laid-on level on the paper; and the following evaluation was performed.

paper: CS-680 (A4, 68.0 $g/m^2$)

(sold by Canon Marketing Japan Inc.)

toner laid-on level on paper: 0.90 $mg/cm^2$ evaluation image: placement of 10 $cm^2$ image in the center of the A4 paper fixing test environment: low-temperature, low-humidity environment: temperature of 15° C./humidity of 10% RH ("L/L" below)

The process speed was set to 450 mm/sec; the fixation temperature was adjusted; the fixed image was output; and the state of the fixed image was visually evaluated.

Evaluation Criteria

A: Fixing is possible in the temperature range below 115° C.

B: Fixing is possible in the temperature range equal to or greater than 115° C. and less than 120° C.

C: Fixing is possible in the temperature range equal to or greater than 120° C. and less than 125° C.

D: Fixing is possible in the temperature range equal to or greater than 125° C. and less than 130° C.

E: Fixing is possible only in the temperature range equal to or greater than 130° C.

Evaluation of the Image Storability: A temperature 20° C. higher than the fixability lower temperature limit was set as a secure fixation temperature, and, using GF-C104 (A4, 104 g/cm$^2$) (sold by Canon Marketing Japan Inc.) general-purpose paper for color copiers printers, two prints of a solid image (5 cm×5 cm) having a toner laid-on level of 0.90 mg/cm$^2$ were made on one side of the A4 paper. The recording paper on which the solid image had been formed was stacked face-to-face so the solid images were in contact with each other and was held for 1 day in a temperature=65° C./relative humidity=40% RH environment under the application of a vertical load of 100 g/cm$^2$. The images on the two prints were then separated, and defects (presence/absence of gloss non-uniformity) in the image surface due to image adherence were evaluated. The area percentage that exhibited fluctuation in the gloss value (i.e., the area percentage where gloss non-uniformity was present) was determined by binarization by image processing.

Evaluation Criteria

A: No image defects are present.

B: Gloss non-uniformity occurs in the image. (the area percentage that exhibits fluctuation in the gloss value is less than 2%)

C: Gloss non-uniformity occurs in the image. (the area percentage that exhibits fluctuation in the gloss value is at least 2%, but is less than 5%)

D: Gloss non-uniformity occurs in the image. (the area percentage that exhibits fluctuation in the gloss value is at least 5%, but is less than 10%)

E: The image undergoes peeling.

Developer 1 received a score of A for each of the items evaluated as described above.

Examples 2 to 10: Toners 2 to 10 Production Example: Toners 2 to 10 were obtained proceeding as in the Toner 1 Production Example, but changing the type and amount of addition of the binder resin and crystalline polyester as indicated in Table 2.

TABLE 2

| toner No. | binder resin No. | crystalline polyester No. | amount of crystalline polyester addition (mass parts) | crystalline polyester content (mass parts) | toner Tg (° C.) | ΔH1 (J/g) | ΔH2 (J/g) | ΔH2/ΔH1 |
|---|---|---|---|---|---|---|---|---|
| 1 | 1 | 1 | 5 | 5 | 53 | 4.9 | 3.5 | 0.71 |
| 2 | 2 | 1 | 8 | 8 | 50 | 7.3 | 5.1 | 0.70 |
| 3 | 3 | 1 | 3 | 3 | 55 | 2.8 | 2.0 | 0.71 |
| 4 | 4 | 1 | 8 | 8 | 55 | 6.3 | 4.4 | 0.70 |
| 5 | 5 | 1 | 8 | 8 | 55 | 5.0 | 3.5 | 0.70 |
| 6 | 6 | 2 | 2 | 2 | 55 | 1.2 | 0.6 | 0.50 |
| 7 | 7 | 2 | 12 | 12 | 55 | 10.5 | 5.4 | 0.51 |
| 8 | 8 | 2 | 14 | 14 | 45 | 12.1 | 6.1 | 0.50 |
| 9 | 9 | 2 | 14 | 14 | 60 | 12.1 | 6.1 | 0.50 |
| 10 | 10 | 3 | 14 | 14 | 44 | 0.5 | 0.2 | 0.40 |

The content (mass parts) for the crystalline polyester in the table is the value per 100 mass parts of the binder resin.

Developers 2 to 10 Production Example: Developers 2 to 10 were obtained proceeding as in the Developer 1 Production Example, but changing the toner as indicated in Table 3. The same evaluations were performed as in Example 1. The results of the evaluations are given in Table 3.

TABLE 3

| example No. | toner No. | developer No. | fixability lower limit temperature (° C.) | low-temperature fixability rank | area percentage that exhibits fluctuation in the gloss value (%) | image storability rank |
|---|---|---|---|---|---|---|
| 1 | 1 | 1 | 110 | A | 0 | A |
| 2 | 2 | 2 | 110 | A | 0 | A |
| 3 | 3 | 3 | 110 | A | 0 | A |
| 4 | 4 | 4 | 115 | B | 0 | A |
| 5 | 5 | 5 | 115 | B | 0 | A |
| 6 | 6 | 6 | 117 | B | 1.2 | B |
| 7 | 7 | 7 | 117 | B | 1.4 | B |
| 8 | 8 | 8 | 117 | B | 3.4 | C |
| 9 | 9 | 9 | 117 | B | 3.6 | C |
| 10 | 10 | 10 | 120 | C | 3.6 | C |

Comparative Examples 1 to 4: Toners 11 to 14 Production Example: Toners 11 to 14 were obtained proceeding as in the Toner 1 Production Example, but changing the type and amount of addition of the binder resin and crystalline polyester as indicated in Table 4.

TABLE 4

| toner No. | binder resin No. | crystalline polyester No. | amount of crystalline polyester addition (mass parts) | crystalline polyester content (mass parts) | toner Tg (° C.) | ΔH1 (J/g) | ΔH2 (J/g) | ΔH2/ΔH1 |
|---|---|---|---|---|---|---|---|---|
| 11 | 9 | — | 0 | 0 | 65 | 0.0 | 0.0 | — |
| 12 | 11 | 2 | 14 | 14 | 42 | 11.5 | 4.6 | 0.40 |
| 13 | 12 | — | 0 | 0 | 65 | 0.0 | 0.0 | — |
| 14 | 11 | — | 0 | 0 | 44 | 0.0 | 0.0 | — |

The content (mass parts) for the crystalline polyester in the table is the value per 100 mass parts of the binder resin.

Developers 11 to 14 Production Example: Developers 11 to 14 were obtained proceeding as in the Developer 1 Production Example, but changing the toner as indicated in Table 5. The same evaluations were performed as in Example 1. The results of the evaluations are given in Table 5.

TABLE 5

| comparative example No. | toner No. | developer No. | fixability lower limit temperature (° C.) | low-temperature fixability rank | area percentage that exhibits fluctuation in the gloss value (%) | image storability rank |
|---|---|---|---|---|---|---|
| 1 | 11 | 11 | 125 | D | 4.3 | C |
| 2 | 12 | 12 | 123 | C | 8.2 | D |
| 3 | 13 | 13 | 140 | E | 4.4 | C |
| 4 | 14 | 14 | 117 | B | the image underwent peeling | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A toner, comprising:

a toner particle comprising a binder resin and a crystalline polyester, the binder resin comprising a polyester having a structure represented by formula (1)

(1)

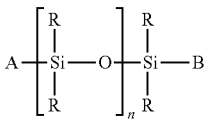

where Rs independently represent hydrogen, a methyl group or a phenyl group;

A represents a polyester segment;

B represents a polyester segment or is selected from the group consisting of —$R^1$OH, —$R^1$COOH,

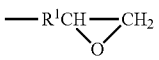

and —$R^1NH_2$ wherein $R^1$ represents a single bond or a $C_{1-4}$ alkylene group; and average repeat number n is 10 to 80, wherein ΔH1 is 1.0 to 10.0 J/g and (ΔH2/ΔH1) is 0.50 to 1.00 when ΔH1 is the endothermic quantity originating with the crystalline polyester in a first heating-up step measured on the toner by differential scanning calorimetry, and ΔH2 is the endothermic quantity originating with the crystalline polyester in a second heating-up step measured on the toner by differential scanning calorimetry.

2. The toner according to claim 1, which has a glass transition temperature in the second heating-up step of 45 to 60° C.

3. The toner according to claim 1, which has a crystalline polyester content of 2.0 to 12.0 mass parts per 100 mass parts of the binder resin.

4. The toner according to claim 1, wherein the polyester having the structure represented by formula (1) comprises 0.5 to 5.0 mass % of the structure represented by formula (2)

(2)

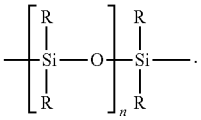

5. The toner according to claim 1, wherein each of the Rs is the methyl group.

6. The toner according to claim 1, wherein the crystalline polyester is a polycondensate of an aliphatic diol having 6 to 18 carbons with an aliphatic dicarboxylic acid compound having 6 to 18 carbons.

* * * * *